US009797134B2

(12) United States Patent
MacAllen et al.

(10) Patent No.: US 9,797,134 B2
(45) **Date of Patent: *Oct. 24, 2017**

(54) FLEXIBLE FURNITURE SYSTEM

(71) Applicant: molo design, ltd., Vancouver (CA)

(72) Inventors: Todd P. MacAllen, Vancouver (CA); Stephanie J. Forsythe, Vancouver (CA)

(73) Assignee: molo design, ltd., Vancouver (CA)

( * ) Notice: Subject to any disclaimer, the term of this patent is extended or adjusted under 35 U.S.C. 154(b) by 0 days.

This patent is subject to a terminal disclaimer.

(21) Appl. No.: 15/211,831

(22) Filed: Jul. 15, 2016

(65) Prior Publication Data

US 2017/0074496 A1 Mar. 16, 2017

Related U.S. Application Data

(63) Continuation of application No. 12/343,042, filed on Dec. 23, 2008, now Pat. No. 9,394,686, which is a (Continued)

(30) Foreign Application Priority Data

Nov. 25, 2005 (CA) ..... 2527927

(51) Int. Cl.
*E04B 2/74* (2006.01)
*A47C 4/04* (2006.01)
(Continued)

(52) U.S. Cl.
CPC ..... *E04B 2/7401* (2013.01); *A47C 4/04* (2013.01); *A47C 5/005* (2013.01); *E04B 1/00* (2013.01);
(Continued)

(58) Field of Classification Search
CPC ..... F21V 33/006; F21S 8/024; E04B 2/7401; E04B 1/00; E04B 2/7433; E04B 2/7405; E06B 9/262
(Continued)

(56) References Cited

U.S. PATENT DOCUMENTS 2,101,836 A 12/1937 Benedict
2,324,398 A 7/1943 Kahr
(Continued)

FOREIGN PATENT DOCUMENTS

CA 1166951 5/1984
CA 2586759 11/2006
(Continued)

OTHER PUBLICATIONS

Pedersen, Martin C.; "The Soft House"; Metropolis Magazine, Jul. 2004, New York.
(Continued)

*Primary Examiner* — Blair M Johnson
(74) *Attorney, Agent, or Firm* — Blake, Cassels & Graydon LLP; Wilfred P. So

(57) ABSTRACT

An article of flexible furniture having a core formed from a plurality of laminar panels of a flaccid material and each panel having a pair of oppositely directed major faces, adjacent faces of said panels being inter-connected to provide a cellular structure upon movement of abutting faces away from each other, a pair of supports at opposite ends of said core and connected to respective ones of said faces, said supports being self-supporting to provide rigidity to said core whereby said supports may be moved apart to expand said cellular and extend the length of said partition.

20 Claims, 20 Drawing Sheets

Related U.S. Application Data continuation-in-part of application No. 11/742,984, filed on May 1, 2007, now Pat. No. 7,866,366, which is a continuation-in-part of application No. 11/287,195, filed on Nov. 28, 2005, now abandoned.

(60) Provisional application No. 60/681,972, filed on May 18, 2005.

(51) Int. Cl.
*A47C 5/00* (2006.01)
*E04B 1/00* (2006.01)
*E06B 9/262* (2006.01)

(52) U.S. Cl.
CPC ..... *E04B 2/7405* (2013.01); *E04B 2/7433* (2013.01); *E06B 9/262* (2013.01)

(58) Field of Classification Search
USPC ..... 362/147
See application file for complete search history.

(56) References Cited

U.S. PATENT DOCUMENTS

| | | | | |
|---|---|---|---|---|
| 2,346,824 | A | 4/1944 | Cohen | |
| 3,170,831 | A | 2/1965 | Paige | |
| 3,502,113 | A | 3/1970 | Bjorksten | |
| 3,975,882 | A | 8/1976 | Walter | |
| 4,052,828 | A | 10/1977 | Mancini et al. | |
| 4,209,162 | A | 6/1980 | Petiau | |
| 4,247,583 | A | 1/1981 | Roy | |
| 4,671,334 | A | 6/1987 | Yadegar et al. | |
| 4,677,012 | A * | 6/1987 | Anderson | B31D 3/0215 156/197 |
| 4,694,144 | A | 9/1987 | Delaroche et al. | |
| 4,733,711 | A * | 3/1988 | Schon | E06B 9/262 160/279 |
| 4,934,434 | A | 6/1990 | Schnebly et al. | |
| 4,970,831 | A | 11/1990 | Rota | |
| 5,078,195 | A | 1/1992 | Schon | |
| 5,111,866 | A | 5/1992 | Prostko | |
| 5,193,601 | A | 3/1993 | Corey et al. | |
| 5,314,226 | A | 5/1994 | Tovar | |
| 5,373,916 | A | 12/1994 | Kiviniemi et al. | |
| 5,406,760 | A | 4/1995 | Edwards | |
| 5,690,778 | A | 11/1997 | Swiszcz et al. | |
| 5,903,992 | A | 5/1999 | Eisenberg | |
| 6,019,864 | A | 2/2000 | Jones | |
| 6,283,191 | B1 | 9/2001 | Lo | |
| 6,427,409 | B2 | 8/2002 | Colson et al. | |
| 6,431,936 | B1 | 8/2002 | Kiribuchi | |
| 6,527,895 | B1 | 3/2003 | Palmer | |
| 6,755,453 | B2 | 6/2004 | Kellas | |
| 6,764,200 | B1 | 7/2004 | Wu Lu | |
| 6,959,752 | B2 | 11/2005 | Huang | |
| 7,866,366 | B2 | 1/2011 | MacAllen et al. | |
| 8,561,666 | B2 * | 10/2013 | MacAllen | A47C 4/04 108/157.14 |
| 9,243,403 | B2 * | 1/2016 | MacAllen | A47C 4/04 |
| 9,290,935 | B2 * | 3/2016 | MacAllen | A47C 4/04 |
| 9,309,668 | B2 * | 4/2016 | MacAllen | A47C 4/04 |
| 9,394,686 | B2 * | 7/2016 | MacAllen | A47C 4/04 |
| 9,512,615 | B2 * | 12/2016 | MacAllen | A47C 4/04 |
| 2001/0009179 | A1 | 7/2001 | Huang | |
| 2002/0043346 | A1 | 4/2002 | Zorbas | |
| 2002/0179558 | A1 | 12/2002 | Venegas | |
| 2003/0156426 | A1 | 8/2003 | Givoletti | |
| 2005/0008826 | A1 | 1/2005 | Snel | |
| 2005/0039363 | A1 | 2/2005 | Galey | |
| 2005/0076552 | A1 | 4/2005 | Tolina et al. | |
| 2005/0162850 | A1 | 7/2005 | Luk et al. | |
| 2006/0082987 | A1 * | 4/2006 | Dorsey | F21S 48/215 362/103 |
| 2006/0260231 | A1 | 11/2006 | MacAllen et al. | |
| 2007/0182666 | A1 * | 8/2007 | Hochman | G09F 19/22 345/46 |
| 2009/0189419 | A1 | 7/2009 | Wu et al. | |
| 2014/0096917 | A1 | 4/2014 | MacAllen et al. | |

FOREIGN PATENT DOCUMENTS

| | | | |
|---|---|---|---|
| DE | 2517579 | A1 | 7/1976 |
| DE | 202008002395 | U1 | 5/2008 |
| EP | 1811095 | A2 | 7/2007 |
| WO | 2005056899 | | 6/2005 |
| WO | 2007048951 | | 5/2007 |
| WO | 2008144537 | | 11/2008 |

OTHER PUBLICATIONS

Dempster, Victoria; PCT International Search Report PCT/CA2009/001903; search completed Apr. 19, 2010.

"Acknowledegtment of receipt of observations by third parties (Art. 115 EPC); issued in corresoponding EP Patent Application No. EP09833988; dated Jun. 15, 2011."

"Petrinja, Etiel; Supplemental European Search Report from corresponding EP application No. EP09833988; search completed Feb. 20, 2014."

"http://www.balkanyug.bg/new/index.php?page=shop.browse&category_id=103&option=com_virtuemart&Itemid=4—products of Balcan Yug OOD from Haskovo, Bulgaria; retrieved from the Internet May 1, 2013."

"http://www.lessocenter.com/products-49.html—products of Lesoncentar OOD, Trojan, Bulgaria; retrieved from the Internet May 1, 2013."

"http://kori-vrati.g-m.bg/—products of G&M from Varna, Bulgaria; retrieved from the Internet May 1, 2013."

"Timmyvirus111; ""Flexible Love"" Folding Chair; http://www.youtube.com/watch?v=LbEEXMIhZR0; retrieved from the Internet May 1, 2013."

"Rushtang72; Paper Sofa Folding Chair Carton Furniture; http://www.youtube.com/watch?v=8s5GWX6QyBs; retrieved from the Internet May 1, 2013."

"Paparazzia; Folding Chair; http://www.youtube.com/watch?v=t9dNbQCHfMc; retrieved from the Internet May 1, 2013."

"ONETWO easy-2-do event furniture; Product Catalogue 2005."

* cited by examiner (a)

(b)

FLEXIBLE FURNITURE SYSTEM

CROSS-REFERENCE TO RELATED APPLICATIONS

This application is a continuation of U.S. patent application Ser. No. 12/343,042 filed on Dec. 23, 2008, which is a continuation-in-part of U.S. patent application Ser. No. 11/742,984 filed on May 1, 2007, which is a continuation-in-part of U.S. patent application Ser. No. 11/287,195 filed on Nov. 28, 2005, which claims priority from Canadian Patent Application No. 2,527,927 filed on Nov. 25, 2005 and U.S. Provisional Application No. 60/681,972 filed on May 18, 2005 all of which are incorporated herein by reference.

FIELD OF THE INVENTION

The present invention relates to flexible furniture components and methods of making such components.

DESCRIPTION OF THE PRIOR ART

Furniture is a staple product used in domestic, working and public environments. Furniture may be used to facilitate the use of space, such as in a seat or table, or to divide space, such as in a partition. By way of example, partitions are frequently used to subdivide spaces, or to create more intimate spaces. Typically such partitions are rigid, or have rigid frames, or are formed from rigid interconnected panels and they are relatively large, heavy, and cumbersome, and therefore difficult to set-up, take down, store, and transport. Similarly other items of furniture, such as seating structures, are typically of a rigid, or permanent nature that, at most, are moveable to alternative locations.

Moreover, the inherent rigidity of such items of furniture limits the extent to which they can be dynamically resized (extended or contracted) and reshaped to suit varying spaces and requirements, or readily moved around for relocation, or storage.

Additionally, such furniture items, particularly in the form of partitions are typically formed from opaque panels which inhibit the transmission of light, therefore necessitating increased use of, or rearrangement of artificial lighting to restore adequate lighting levels.

In domestic, working, and public environments it is frequently desirable to be able to subdivide and reshape space on a temporary basis. For example, visitors may require a temporary sitting or sleeping area, office workers may need to convert an open plan area into subdivided working space or temporary meeting space, trade show participants may need to demarcate a temporary display area, and designers may need to create and shape a temporary area for an event, or a backdrop for a designed area, such as in a window display in a retail setting, in a showroom, or in a theatrical setting. For these types of applications, furniture components that are rigid, heavy, and/or cumbersome may be costly to transport, difficult to set up/take down, and may require significant storage space. Furniture in the form of a partition that is rigid will also place significant constraints on the ways in which a given space can be partitioned, limiting its functionality, and a partition that is fully opaque will severely disturb natural lighting.

It is therefore an object of the present invention to provide articles of furniture in which the above disadvantages are obviated or mitigated.

SUMMARY OF THE INVENTION

According therefore to one aspect of the present invention there is provided an article of furniture having a core formed from a plurality of laminar panels of a flexible flaccid material. Each panel has a pair of oppositely-directed major faces with faces of adjacent panels being inter-connected to provide a cellular structure upon movement of the faces away from each other. A respective one of a pair of supports is provided at opposite ends of the core and connected to respective ones of the faces. The supports are self-supporting to provide rigidity to the article of furniture and/or to provide connectivity between like articles of furniture. In this way, the supports may be moved apart to expand the cellular structure and extend the overall length of the article of furniture, and/or be used to connect any of more than one of such articles together in series.

BRIEF DESCRIPTION OF THE DRAWINGS

Embodiments of the invention will now be described by way of example only with reference to the accompanying drawings in which.

DETAILED DESCRIPTION OF THE INVENTION

Figure 1:
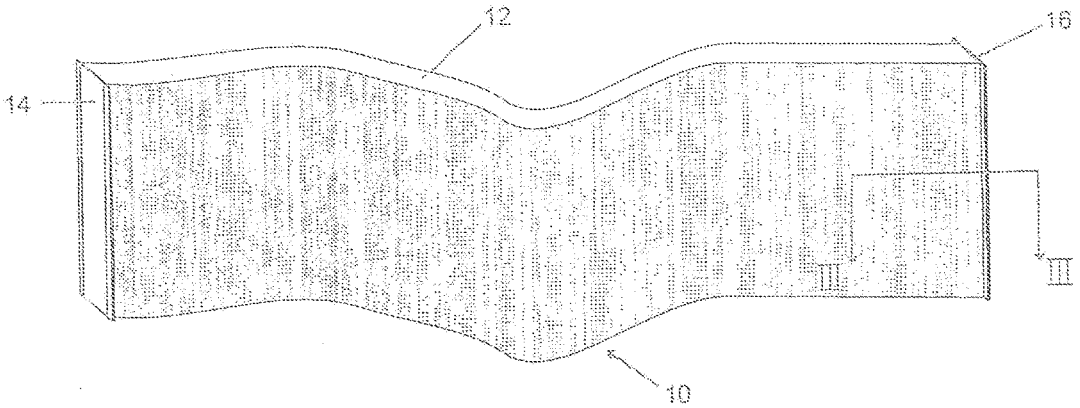
FIG. 1 is a front perspective view of a partition.
Figure 2:
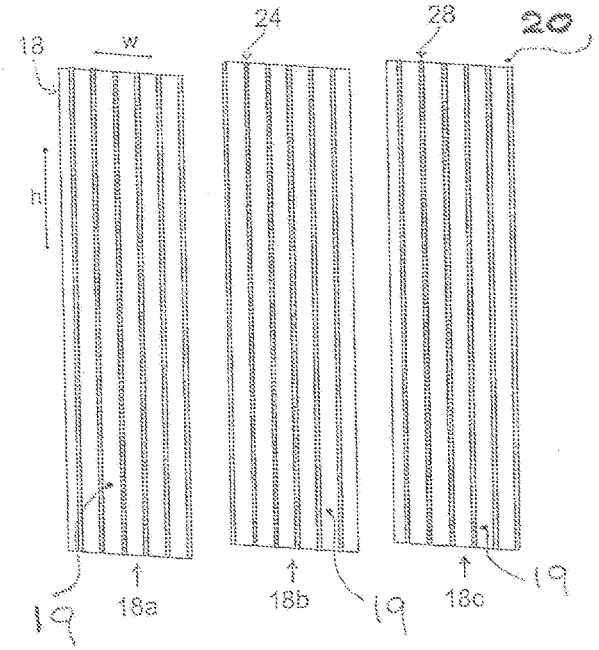
FIG. 2 is a perspective view showing three of the panels used to form the partition of FIG. 1.
Figure 3:
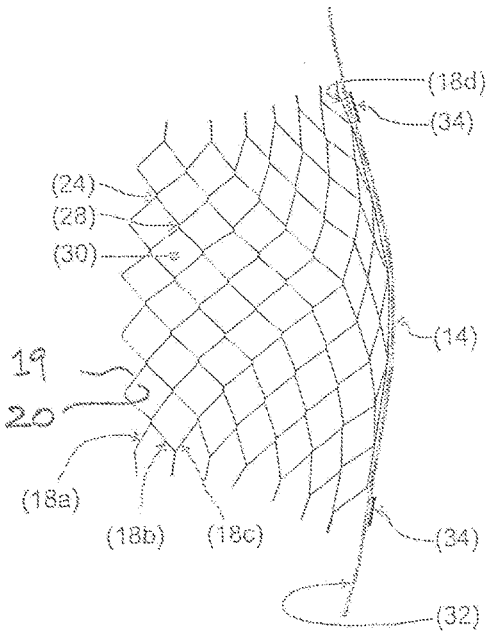
FIG. 3 is a view on the line III-III of FIG. 1.

Referring therefore to FIG. 1, a partition 10 comprises a core 12 and a pair of supports 14, 16 at opposite ends of the core 12. As can best be seen from FIGS. 2 and 3, the core 12 is formed from a plurality of panels 18. The panels 18 each have a pair of oppositely-directed major faces 19, 20, and are formed from a flexible flaccid material. In the preferred embodiment, the material forming the panels 18 is standard white, flame retardant tissue paper, having a weight of approximately 13.5 lbs (500 sheets @ 24"×36"=13.5 lbs). Each panel has a major dimension or height h and a width w which may be adjusted to suit particular environments. Typically the height will be in the order of 1-2 meters but could range from 0.5-3 meters when used as a partition, or 0.1 meters to 0.5 meters when used as a seat. A seat height of 0.45 m has been found particularly beneficial. The width is typically in the order of 30 centimeters but could range from 10-100 centimeters. Adjacent panels 18 are interconnected to one another at spaced intervals that alternate across the width of the face of the panel 18. As indicated in FIG. 2, the connection between panels 18*a* and 18*b* is through a series of parallel, laterally-spaced strips 24 on the face 19 of panel 18*b*. The strips 24 are defined by stripes of adhesive, which connects the panels 18*a*, 18*b* to one another, as shown in FIG. 3.

Similarly, the inter-connection between a panel 18*b* and 18*c* is through spaced parallel strips 28 on the face 19 of panel 18*c* which are offset from the strips 24. Each of the panels 18 is therefore alternately connected to the panel 18 on opposite sides so that, as shown in FIG. 3, upon extension of the panel in a horizontal direction, a cellular structure having voids 30 is formed within the core. The voids 30 extend vertically from top to bottom of the core 12 with the panels 18 providing a continuous transverse barrier. The lateral outer ends of each of the panels 18 are connected so as to form vertical pleats on the exterior faces of the core 12.

An end panel 18*d* of the core is connected to respective ones of the supports 14 and 16 over its entire width. The supports 14 and 16 are made from a self-supporting material, typically a non woven felt material, which has a degree of flexibility but also has sufficient rigidity to resist collapse of the core 12. In a typical application, the felt is a 1.95 nominal pounds per square yard felt having a thickness in the order of 3 millimeters, although other weights and thicknesses may be utilized as appropriate depending upon the overall dimensions of the partition 10. The supports 14 and 16 extend laterally beyond the core as indicated at 32 and are adhered to respective ones of the end panels 18*d*.

Fasteners in the form of a pair of loop and hook strips 34, such as that sold under the trade name "Velcro" are stitched to the felt supports 14 and 16, and extend vertically from one end to the other.

Figure 4:
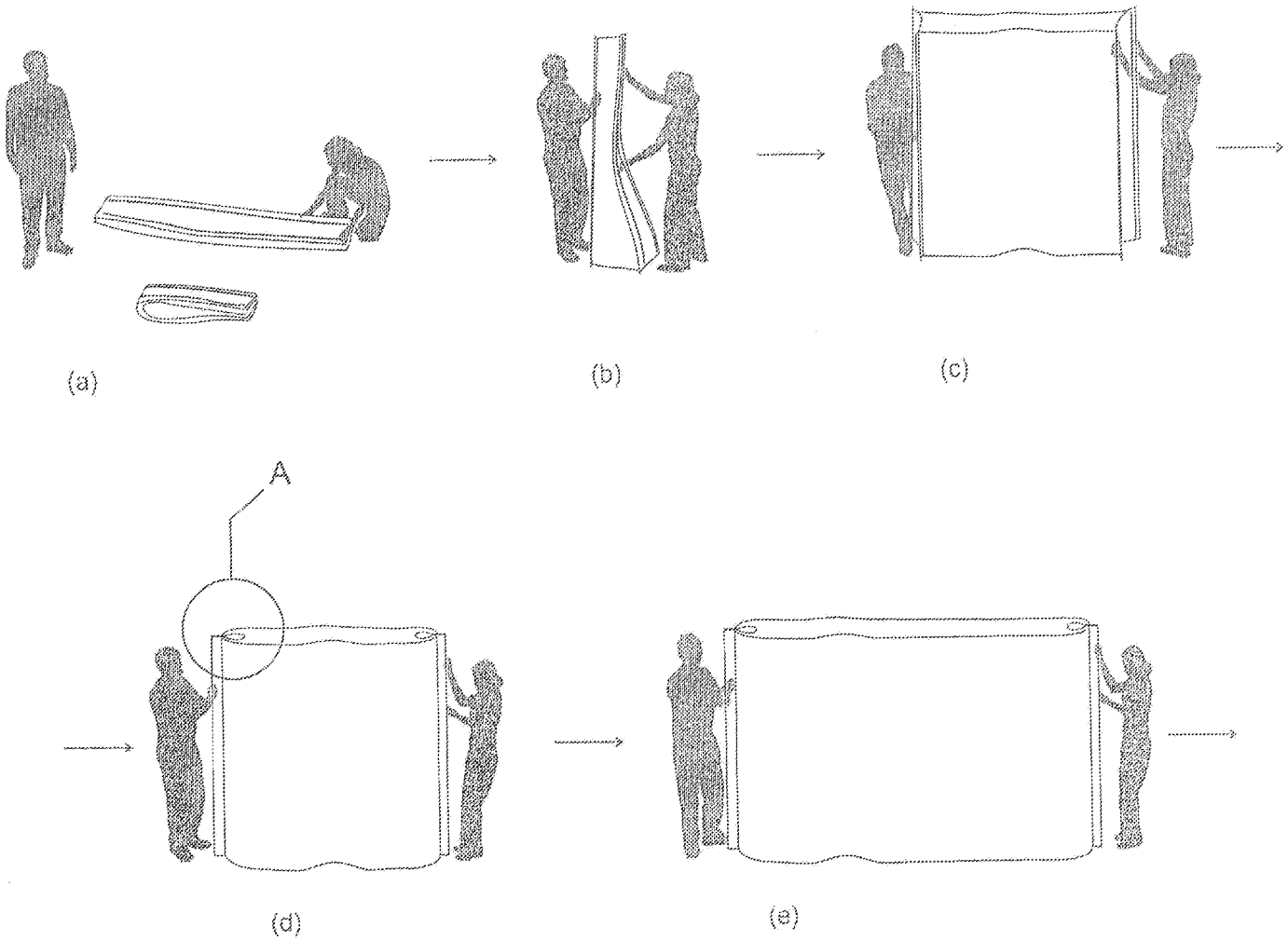
FIG. 4 is a series of views showing the sequential operations required to erect the panel of FIG. 1.

The core 12 is collapsible so that the major faces of adjacent panels 18 lay parallel to one another and in abutment. In this position, as shown in FIG. 4*a*, the partition 10 may be stored in a flat, collapsed position. When the partition 10 is required, it can be oriented vertically (FIG. 4*b*) and the opposite supports 14 and 16 used to manipulate the partition. The supports 14 and 16 are moved away from one another as shown in FIG. 4*c* to expand the core so that the cellular structure is opened within the core 12. The lateral extension of the supports 14, 16 beyond the core 12 provides marginal tabs that may be grasped to facilitate manipulation of the core without direct contact with the panels 18.

Once partially extended, the supports 14 and 16 may be folded along a vertical axis to provide enhanced rigidity at each end of the partition 12. This may be seen in more detail in FIG. 5 where it will be seen that the opposite edges of the supports 14 and 16 may be brought together so that the loop and hook strips 34 are brought into abutment. The loop and hook strips 34 engage one another and thus hold the support in a folded tubular configuration. This movement is accommodated by the flexible nature of the cellular structure which expands towards the lateral edges to accommodate the folding of the supports 14 and 16. With the supports 14 and 16 folded into a tubular support, extension of the core 12 continues as shown in view (e) of FIG. 4, until the desired overall length is reached.

With the partition 10 expanded, it has sufficient width to remain stable in a vertical position with the rigidity provided by the end supports 14 and 16. The material forming the panels 18 is preferably translucent so that a pleasing transmission of light through the panel may occur, while still providing a degree of privacy.

Figure 8:
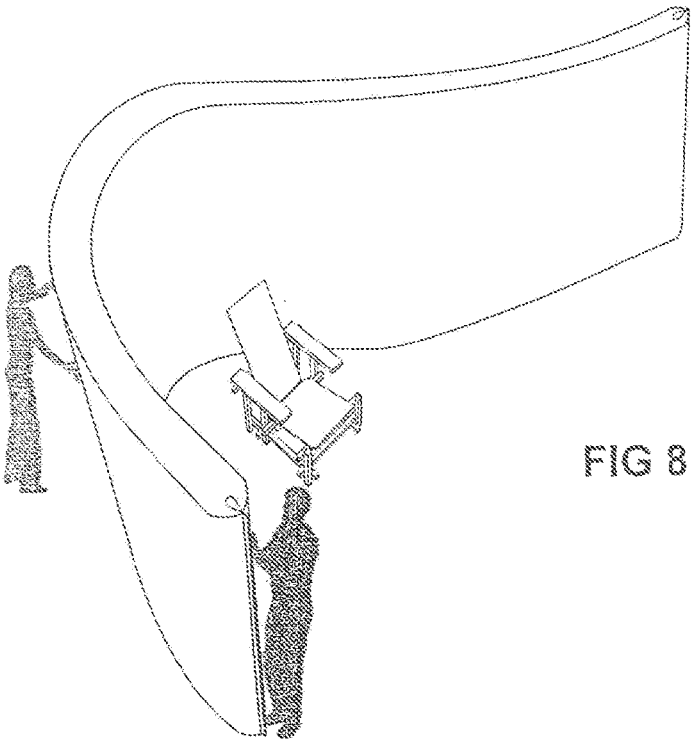
FIG. 8 is a top perspective view showing the arrangement of a panel within a living area.
Figure 9:
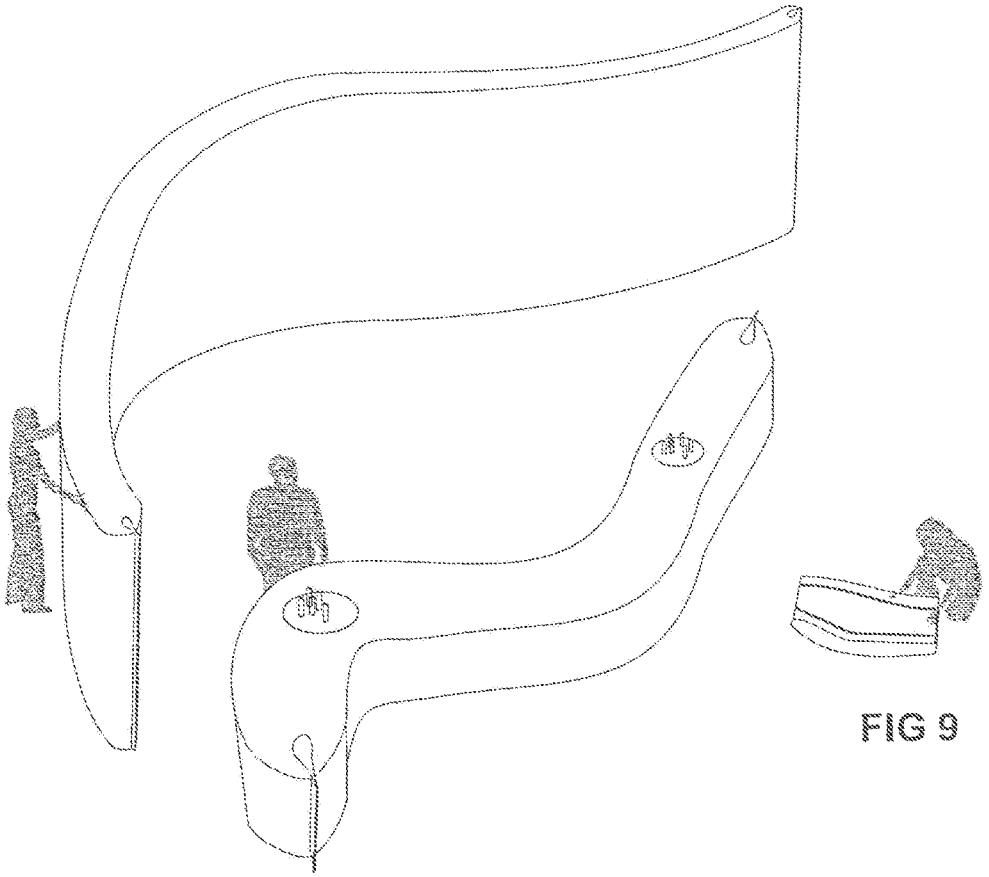
FIG. 9 is a top perspective view showing an alternative configuration of panel.

The extended partition as shown in FIG. 4*e* may be adjusted to different configurations as illustrated by the open curve shown in FIG. 1 and the wrapped curve shown in FIG. 8. The core 12 has a surprising degree of flexibility to accommodate different configurations and allow an appropriate shaped and sized partition to be installed in an otherwise open space. By varying the overall dimensions, additional functionality may be obtained. The extended partition shown in FIG. 4*e* may also be made with a lower height, for example 1 meter and a wider base, for example 0.5 meters so that the top surface of the partition may be used as an area to display objects. Such an arrangement is illustrated in FIG. 9. Where appropriate, the terminal portions of the voids 30 may be used as a pocket to support a container, such as a vase, or similar object. In this embodiment, the height would be between 0.5 and 1.5 meters.

Figure 6:
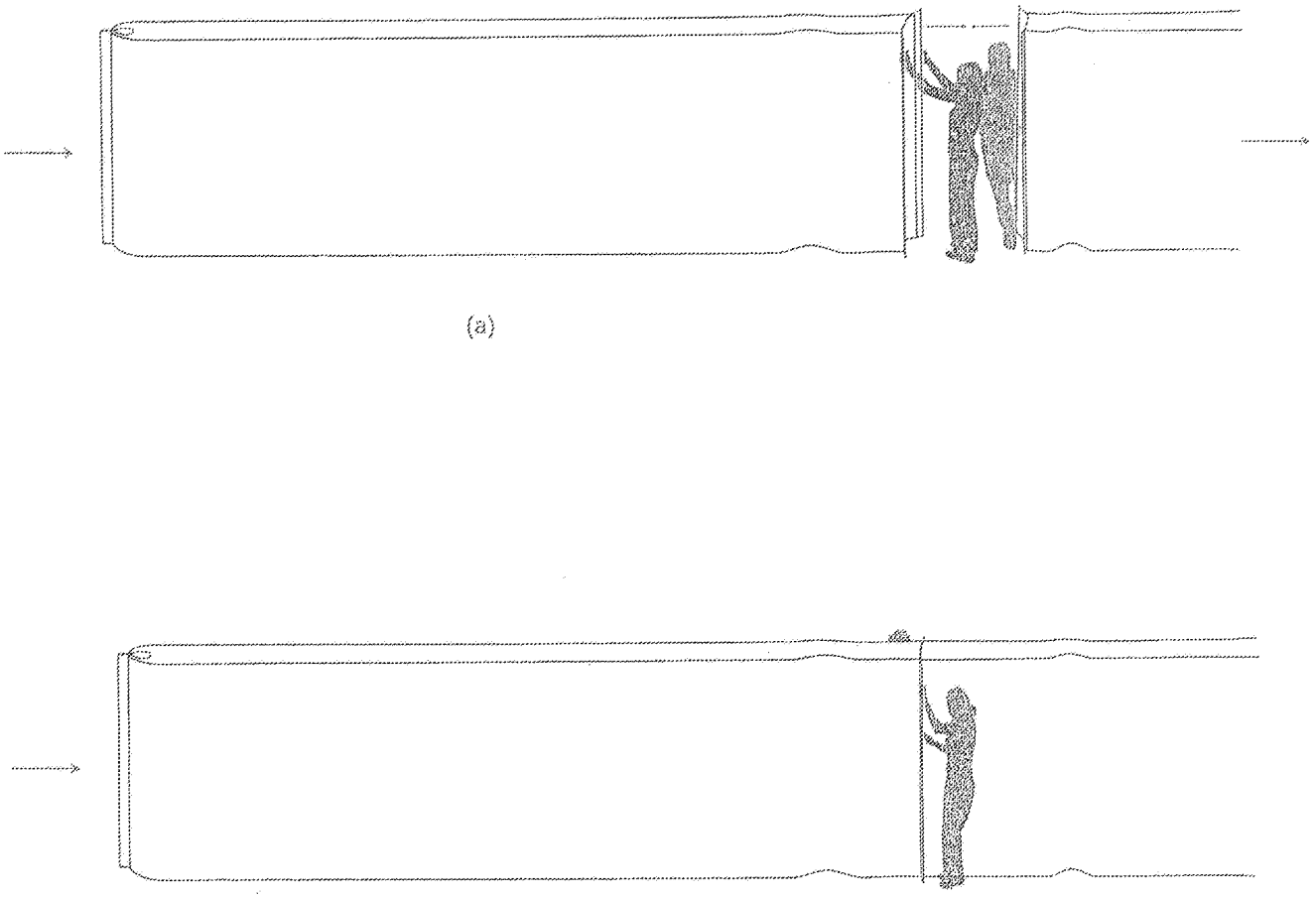
FIG. 6 is a view showing the sequential steps to join a pair of panels shown in FIG. 1 end-to-end.
Figure 7:
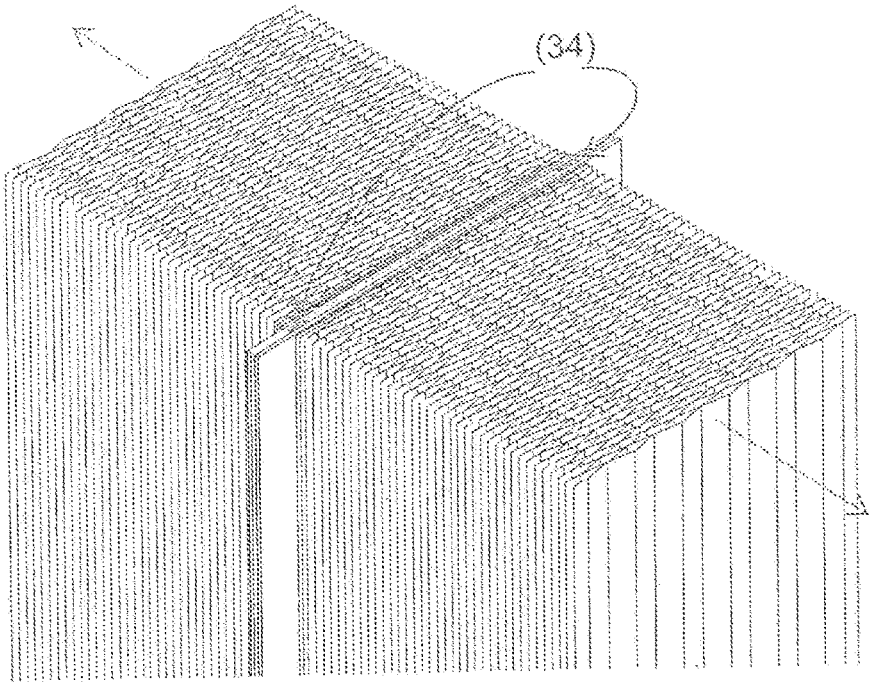
FIG. 7 is a detailed view of the inter-connection of the panels shown in FIG. 6.

The provision of the supports 14 and 16 also permits a pair of partitions 10 to be joined end-to-end as shown in FIG. 6. As may be seen from FIG. 6*a*, a pair of partitions 10 is erected and positioned with supports 14, 16 at opposite ends of each partition adjacent one another. The loop and hook strips 34 in adjacent supports 14, 16 are then brought into contact with one another as shown in FIG. 7 so that the partitions 10 are joined in seriatim. The additional thickness provided by the double support at the intersection enhances rigidity, with the supports 14, 16, at the free ends of the partition being folded upon themselves to provide stable support.

After use of the partition 10, it is simply necessary to reverse the procedure by moving the ends towards one another, unfolding the supports 14 and 16, and collapsing the core 12 to its minimum size. It may then be stored and used when subsequently required.

In the above embodiments, the core has been made from a light weight paper material, although it will be apparent that alternative materials may be used that fulfill the same functional requirements. For example, it is possible to utilize a heavier weight paper material, such as Kraft paper, or a non-woven textile material such as a plastic material known as Tyvek from DuPont which is both tear and water resistant. Alternatively, a paper laminated with a plastic film to provide a composite material may be used. With such a core material, the supports 14 may be made of a felt or may be made from a material similar to the core material but with increased thickness. The felt used in the support would be sufficiently flexible to allow folding to define the tubular support structure at each end with fasteners such as the loop and hook strips 34 incorporated on the support. In some applications, the inherent stiffness of the material used in the core is such as to provide sufficient rigidity to the core when the cellular structure is expanded for the core to be self supporting when expanded. Kraft paper or plastics material has provided sufficient rigidity for this purpose. In this case the supports may be provided to permit connectivity if multiple units are to be joined end to end.

Whilst a translucent material is preferred, it will be apparent that opaque or different coloured materials may also be utilized. The dimensions of the void 30 and the number of voids in the lateral direction may be adjusted to suit particular applications. It has been found in practice that a spacing between stripes 24, 28 in the order of 5-10 centimeters (when unexpanded) is appropriate, although spacing as low as 1 cm. may be used, and that the width of the stripes 24, 28 is between 1 and 10 millimeters. This arrangement provides a flexible structure with extensive elongation to provide maximum functionality.

Figure 10:
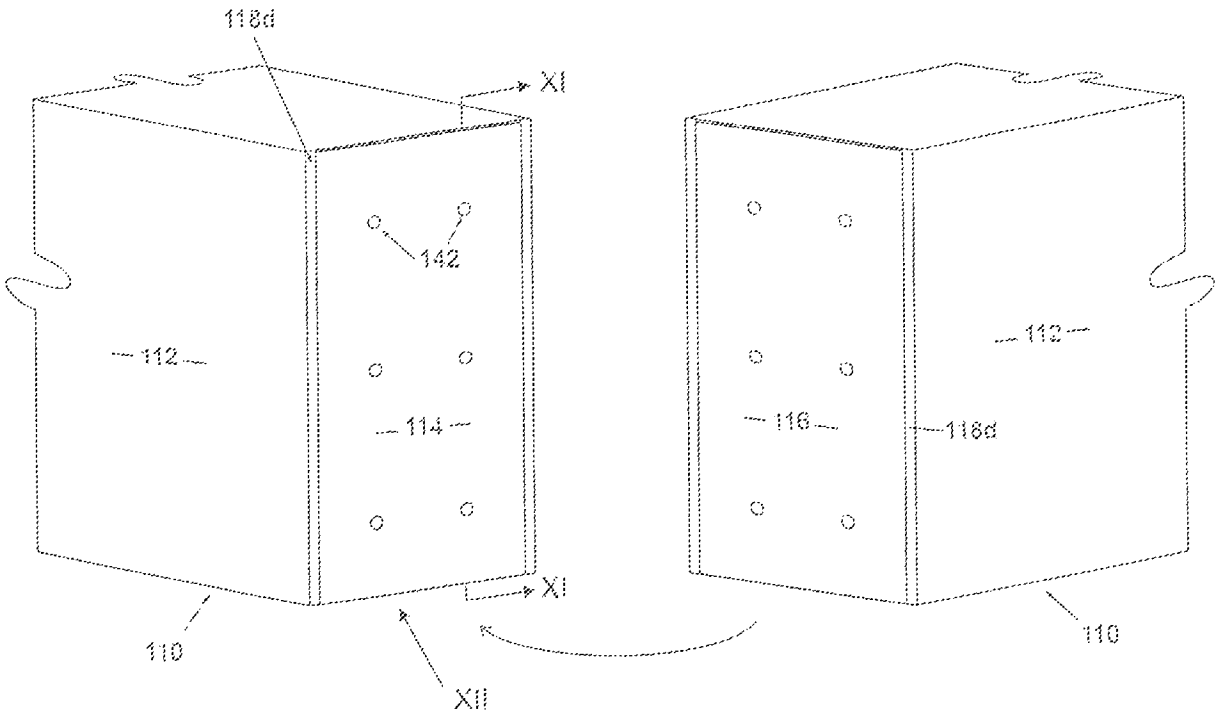
FIG. 10 is a schematic representation of an alternative embodiment of connection applied to a partition.
Figure 11:
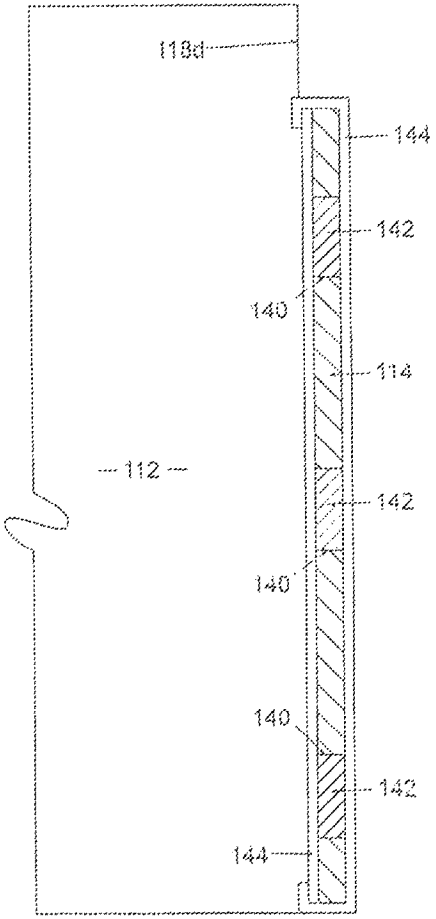
FIG. 11 is a view on the line XI-XI of FIG. 10.
Figure 12:
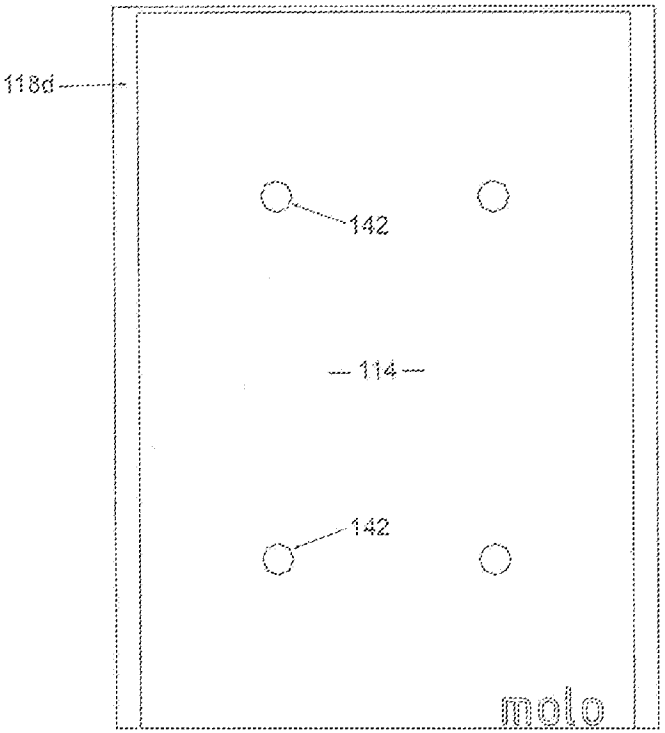
FIG. 12 is a view in the direction of arrow XII of FIG. 11.

An alternative form of connection for articles of flexible furniture is shown in FIG. 10-12, in which like reference numerals will be used to denote like components with a prefix 1 added for clarity. In the embodiment of FIG. 10, a pair of partitions 110 are arranged to be joined end-to-end in a manner similar to that shown in FIG. 6. The end panel 118*d* of the core 112 is secured to supports 114, 116. The supports 114, 116 are made from a self-supporting material, which in this embodiment are preferably made from a rigid material such as a millboard. The supports 114, 116 lay within the periphery of the end panel 118*d* so that the end panels 118*d* overlap by a margin in the order of 20 millimeters around the millboard.

Each of the supports 114, 116 has a series of holes 140, best seen in FIG. 11 formed through the millboard. The holes are arranged in a regular pattern, as will be described more fully below with respect to FIG. 13, and are arranged to receive rare earth magnets 142. The magnets 142 are typically in the order of 3 millimeters thick and 25 millimeters diameter. The magnets are a tight sliding fit in the holes 140 so as to be frictionally retained by the millboard. The millboard itself is chosen to be of the same thickness as the magnet 142 so that the face of the magnet 142 is flush with the surface of the millboard.

The magnets 142 are oriented such that a common polarity is present for all magnets on one face. Thus the magnets in the support 114 shown in FIG. 10 are oriented such that the north pole is exposed and those of the support 116 in the adjacent partition 110 are arranged such that a south pole is exposed. The exposed end face of the millboard is wrapped by a cover 144 of the same material as used to produce the core 112 for aesthetic purposes and to retain the magnets in situ. The cover 144 extends over the edges and each face of the millboard to provide self contained end supports 114, 116 to facilitate manufacture as well as enhance the aesthetics.

With the magnets in situ, the partitions 110 may be connected to one another by relying upon the magnetic attraction between the opposite poles of adjacent partition. The rare earth magnets 142 have sufficient force to retain the supports 114, 116 in abutment with one another. However the supports may be readily separated by sliding the partitions relative to one another or pulling them apart axially to release the magnets. The margin of the end panel 118*d* provides a flexible tab to permit manipulation of the core 112.

Figure 13:
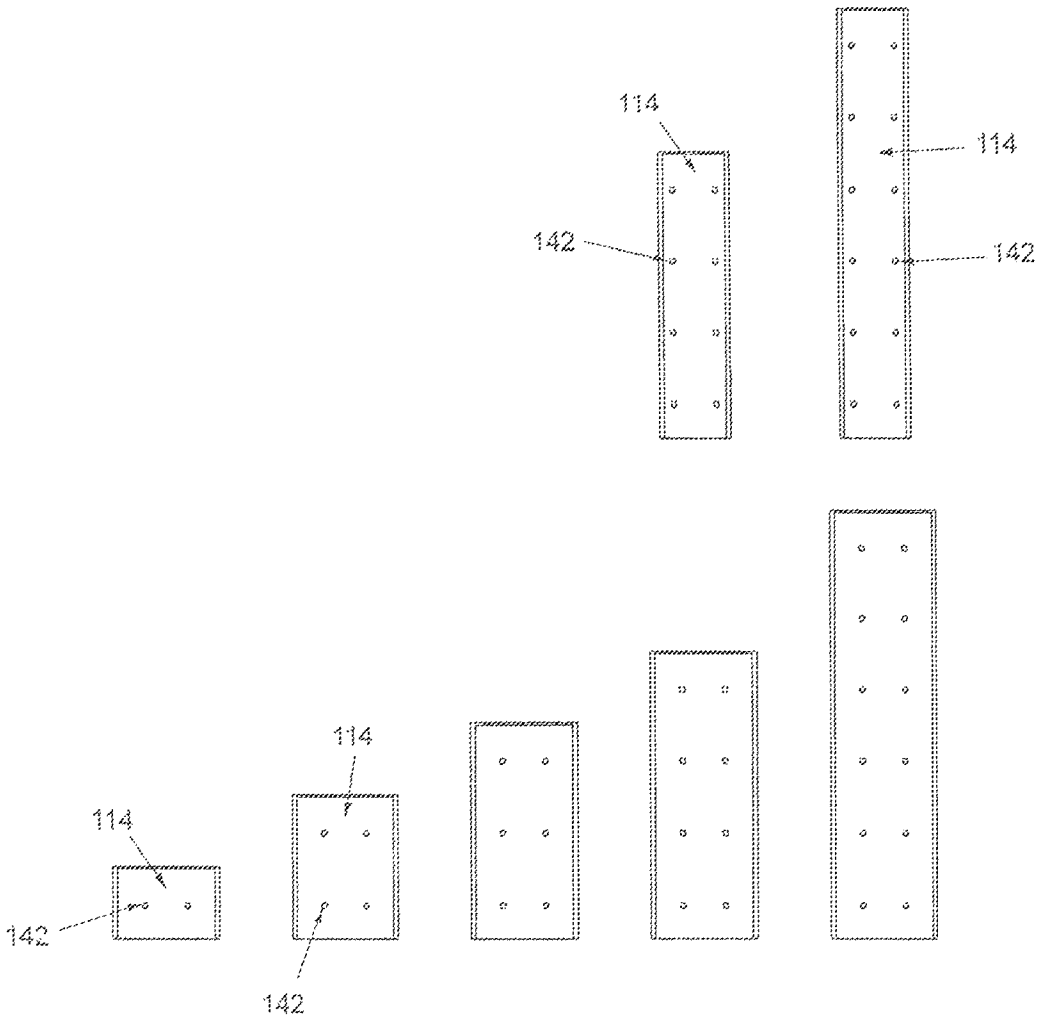
FIG. 13 is a schematic diagram showing the arrangement of the connection of FIG. 10 with different size partitions.

As can be seen in FIG. 13, the arrangement of magnets 142 on the support 114, 116 provides a grid that allows different size partitions to be connected in seriatim. The magnets 142 are arranged in two columns in rows uniformly spaced such that a relatively tall partition may be attached to a relatively small partition with the magnets 142 in alignment. The grid also allows partitions to be stacked on top of one another and connected in seriatim to a taller partition to form a continuous wall.

Figure 5:
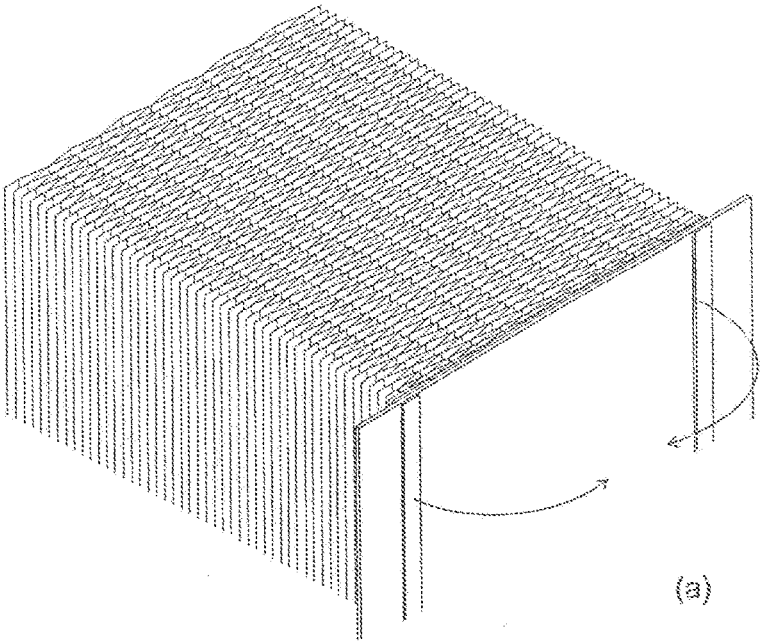
FIG. 5 is a detailed view of the portion shown in circle A in FIG. 4.
Figure 5:
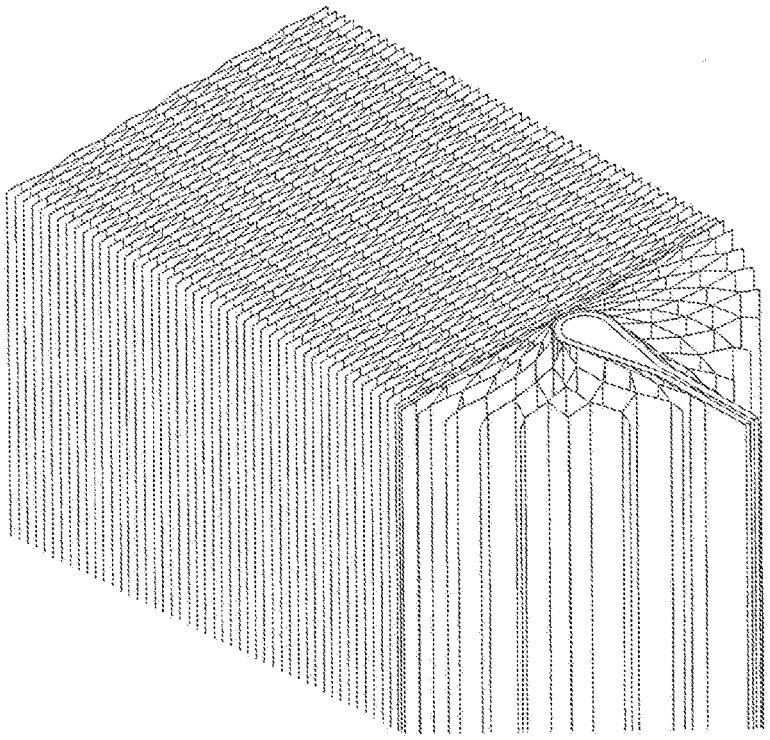

Whilst it is convenient that the supports 114, 116 are formed from rigid millboard to carry the magnets, it will also be apparent that a similar arrangement may be achieved using the self-supporting flexible supports 114, 116 such as the felt shown in the embodiments of FIGS. 1 through 9. The end panel 118*d* and the covering panel 144 secures the magnets 142 within the flexible support 114, 116 so as to be retained within the hole 140. This arrangement would also allow the end panels to be folded as shown in FIG. 5 provided that the orientation of the magnets is such that one column has a north polarity and the other column has a south polarity. A complimentary arrangement on the support of an adjacent partition will still permit the partitions to be joined to one another in seriatim as well as folded.

Figure 14:
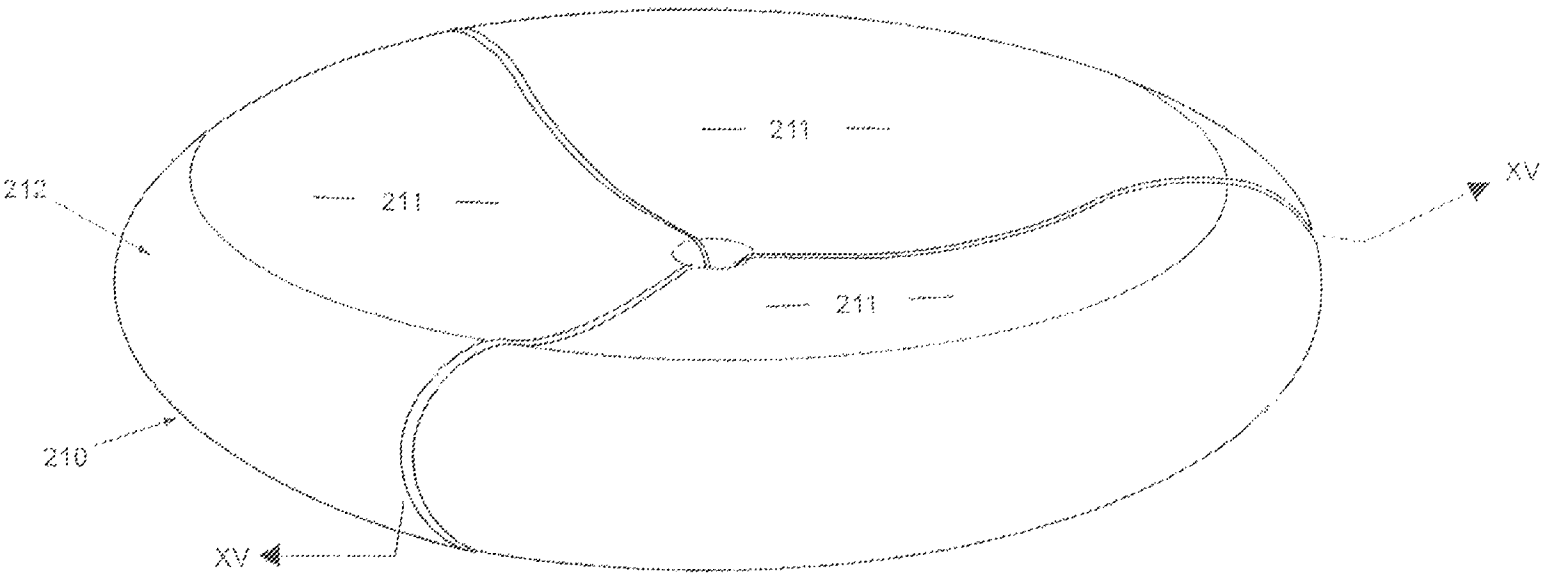
FIG. 14 is a top perspective view of a seat arrangement incorporating the connection of FIG. 10.
Figure 15:
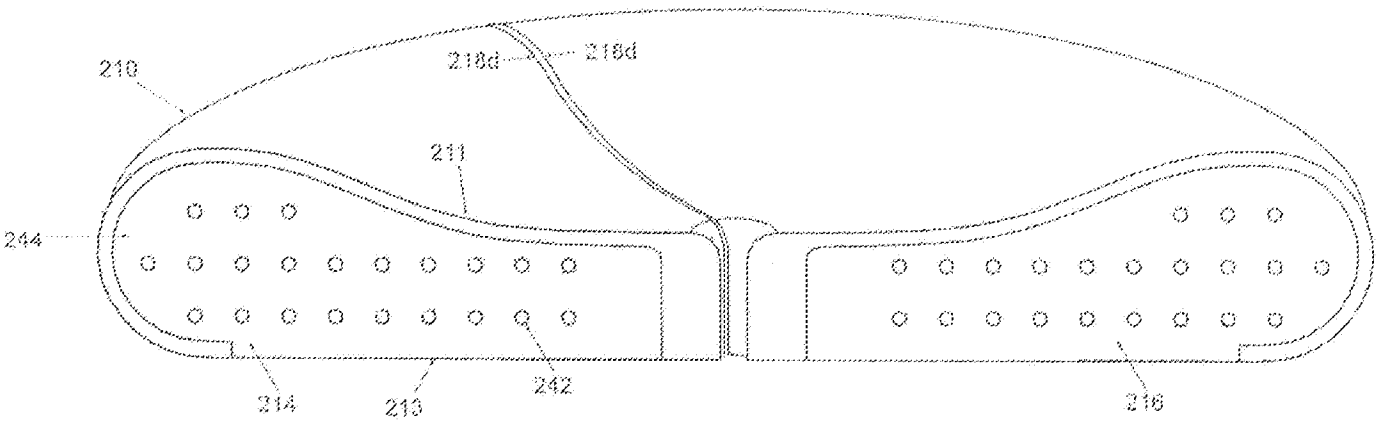
FIG. 15 is a view on the line XV-XV of FIG. 14.

The embodiments are described above in the context of a partition. However, the ability to dimensionally resize the core 12 provides for its use in alternative articles of flexible furniture, such as those shown in FIGS. 14 through 17. In the embodiment of FIG. 14, a circular seat 210 is provided having a concave upper surface 211. As seen in FIG. 15, the lower surface 213 of the core 212 is planar to sit against the floor and the upper and side surfaces smoothly curved. The opposite end faces 218*d* of the core are secured to supports 214, 216 that carry a series of magnets 242. The magnets are wrapped by a cover 244 of the material used to form the core to provide a pleasing aesthetic as well as secure the magnets 242 within the supports 214, 216. The seat 210 may be stored in a collapsed flat position and when needed expanded into a circular array with the supports 214, 216 in abutment. The magnets 242 secure the supports 214, 216 to one another and hold the core 212 in the circular configuration presenting an upper concave surface 211. For storage, the supports are separated and the core collapsed to a flat configuration.

As shown in FIG. 14, the seat 210 is formed from three cores 212 joined end to end to make a torous. It will be apparent that the overall diameter of the seat 210 may be increased by expanding the inner diameter of the torous and thereby further expanding the cores 212. Alternatively, a single core 212 may be used with the supports 214,216 connected to one another, provided there are sufficient laminated panels to permit extension of the core over the required circumference. In this case, the diameter will be similar to that shown in FIG. 14.

A simple seat may be provided in a similar manner by having an expanded core 212 with a planar upper surface 211, arranged either in a cylindrical form with supports 214, 216 in abutment, or in the form of a bench with said supports not in abutment. In each case, multiple units may be joined end to end to increase the diameter of the cylindrical seat, or the length of the bench, which can be arranged linearly, or in an undulating manner, and which can act as a form of partition, as shown in FIGS. 1 to 9, and may be stacked one on top of the other to increase the overall height.

When used in a seating embodiment, the dimensions of the cellular structure and the stiffness of the material used is adjusted to provide an increased structural rigidity and increased weight bearing capacity. kraft paper has been found to have the requisite properties and it has been found preferable to reduce the spacing between the glue stripes to 2.5 cm so that the maximum dimension of each void 30 in a collapsed state is 5 cm.

Figure 16:
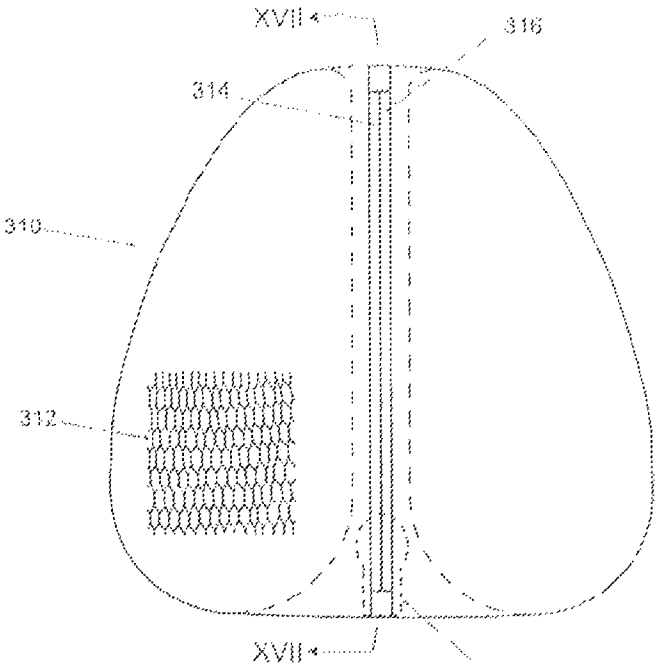
FIG. 16 is a front elevation of a light incorporating a connection similar to FIG. 10.
Figure 17:
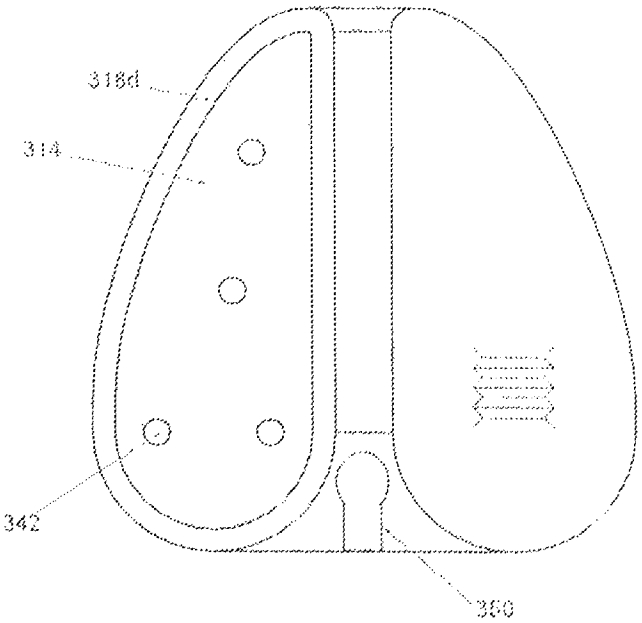
FIG. 17 is a section on the line XVII-XVII of FIG. 16.

A similar arrangement of flexible furniture is used with respect to a light as shown in FIGS. 16 and 17 in which like reference numerals will be used to denote like components with a prefix 3 for clarity. In the embodiments of FIGS. 16 and 17, a light 310 is formed with a core 312 with end panels 318*d* secured to respective supports 314, 316. In this arrangement the axis of the voids is radial although an axial orientation may be used if preferred. The supports, as shown in FIG. 17, carry an array of magnets 342 so that the supports may be joined to one another as described above. A bulb 350 is located within the centre chimney formed by the fanning of the core 312. The bulb 350 illuminates the core 312 to provide a pleasing effect and the heat may escape through the central aperture provided by the core. Naturally the core is formed from a fire-resistant material, or the light source produces only a small amount of heat. The light 310 may be collapsed and stored in a flat configuration and deployed as required in different locations.

A further embodiment of partition is shown in FIGS. 18 through 28 in which similar reference numbers will be used to identify like components for the prefix 4 for clarity. The embodiment of FIGS. 18 through 28 enhances the aesthetic appeal of the partition by taking advantage of the translucent material that is preferably used in the core 12 to.

Figure 18:
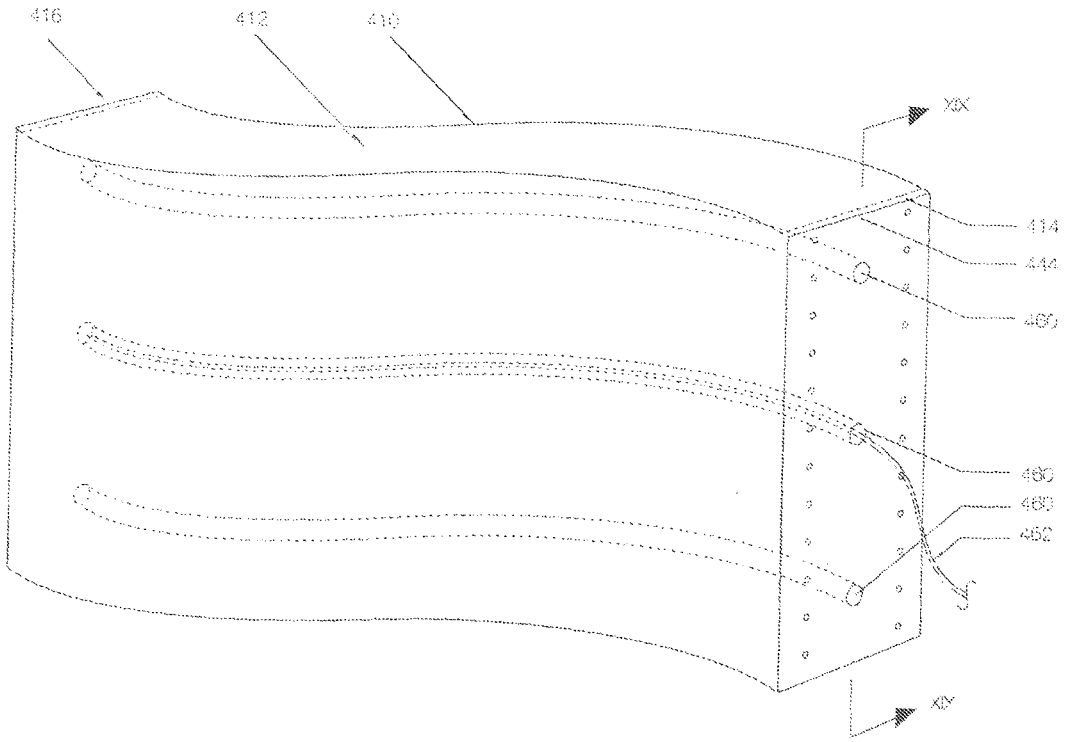
FIG. 18 is a perspective view of a further embodiment of a partition.

Referring therefore to FIG. 18, partition 410 has a core 412 formed from panels of translucent material as particularized above. End supports 414 and 416 are provided at opposite ends of the core 412 and are covered by material 444 for aesthetic purposes.

A series of longitudinal passages 460 extend through the end panels 414, 416 and the core 412. Each of the passages 460 is circular in cross section and is located on the center line of the core 412. The number of passages may vary according to different applications but in the embodiment shown in FIG. 18, three passages 460 are formed through the core 412 at uniformly spaced intervals.

The passages 460 may be conveniently formed with the core 412 in a collapsed condition by using a paper drill bit or similar device, or die cut. Typically a diameter of 2 inches is appropriate for the passage 460.

An LED light ribbon 462 is inserted into one or more of the passages 460 so as to extend through the core 412 to the end support 416. The LED ribbon 462 is a commercially available system such as that available from Alder under the tradename FlexLight Bars. The LED lights are distributed in uniform fashion along the length of the ribbon 462 and are supplied with power from a transformer unit incorporated into an electrical power supply in a conventional manner. A dimmer control may also be included to vary the intensity of the lights.

Figure 19:
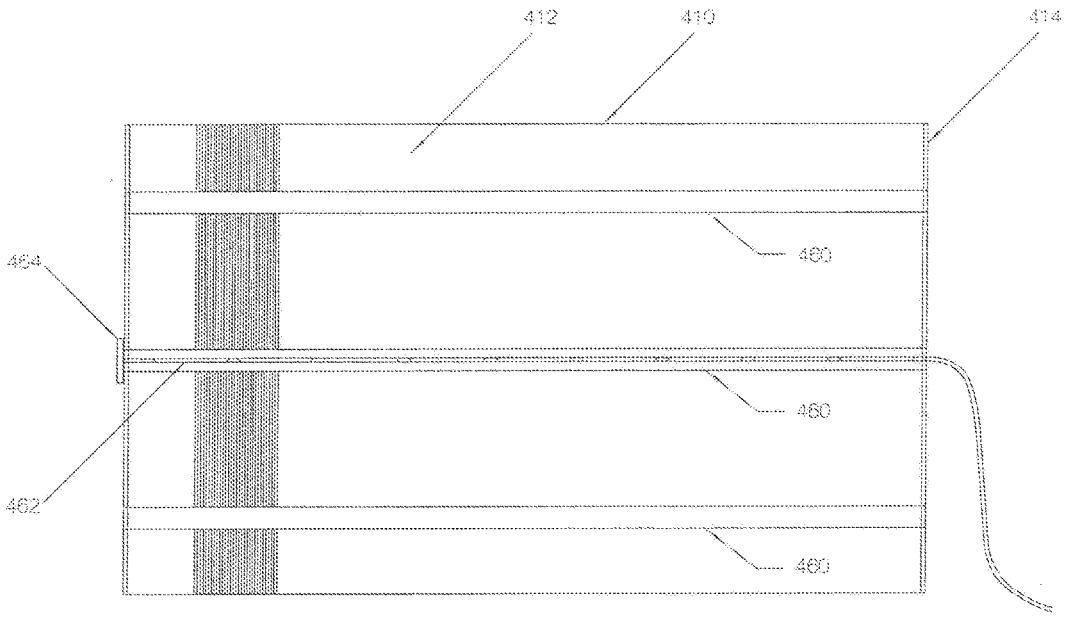
FIG. 19 is a view on the line X1X-X1X of FIG. 18.
Figure 20:
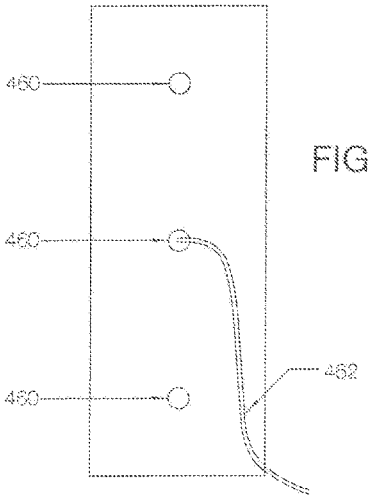
FIG. 20 is an end view of the partition shown in FIG. 18.
Figure 21:
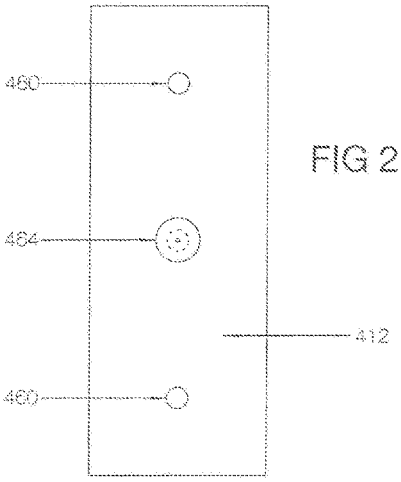
FIG. 21 is a view similar to FIG. 20 of the opposite end of the partition of FIG. 18.
Figure 22:
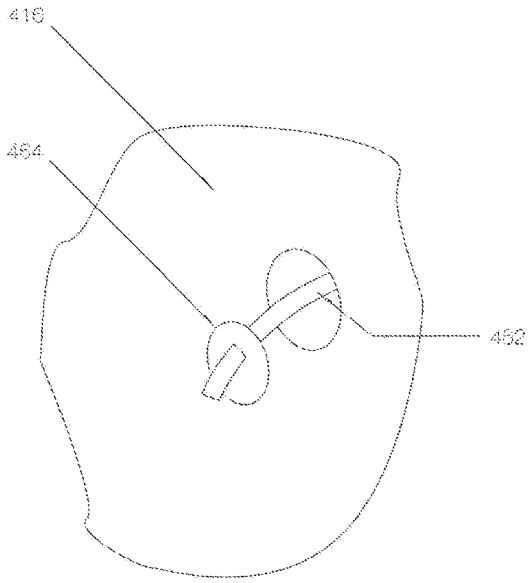
FIG. 22 is an enlarged detailed view of a portion of the end wall of the partition shown in FIG. 21.

As can best be seen in FIGS. 19 and 22, one end of the ribbon 462 is secured relative to the end panel 416 by a disc 464. The disc 464 is secured to the ribbon 462 after it has been inserted through the passage 460 and prevents the ribbon from being withdrawn. The disc 464 has sufficient size to extend beyond the passage 460 and so bears against the end panel 416 to secure the ribbon 462.

Figure 23:
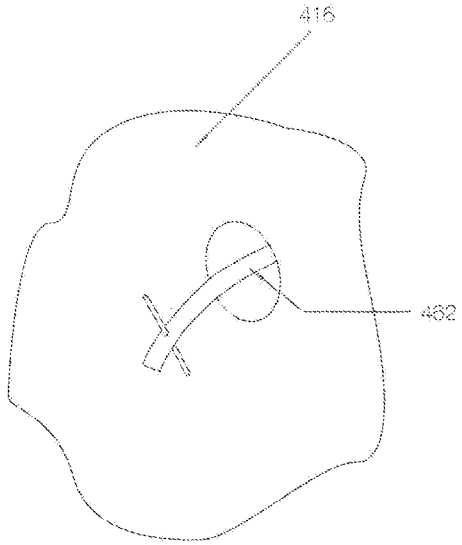
FIG. 23 is a alternative embodiment of the arrangement shown in FIG. 22.
Figure 24:
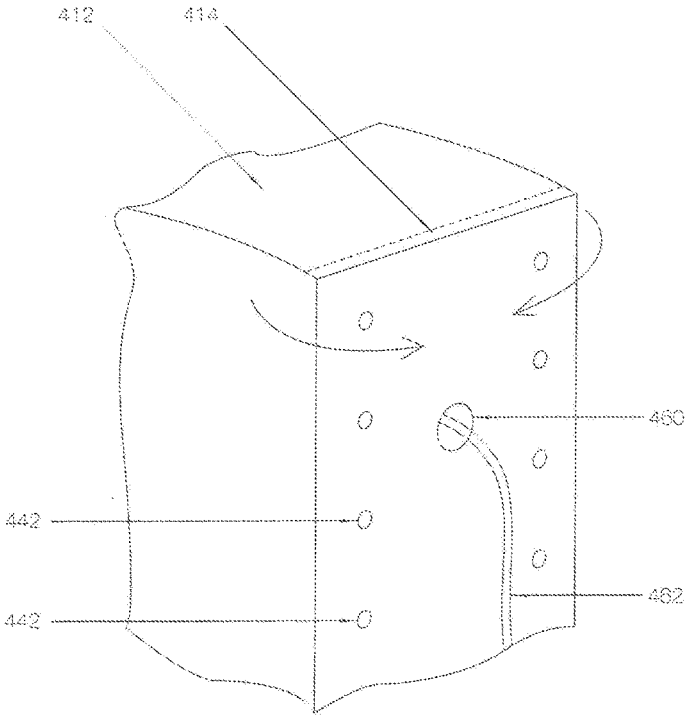
FIG. 24 is an enlarged view of the end of the partition shown in FIG. 20.
Figure 25:
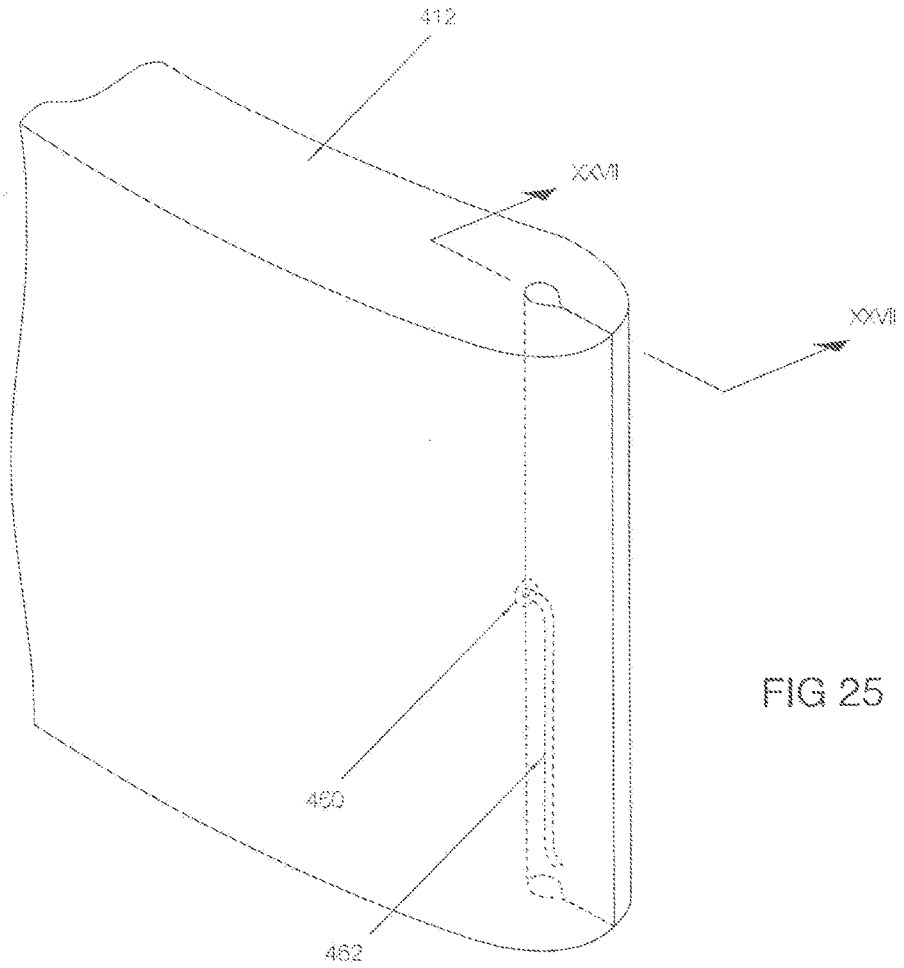
FIG. 25 is a view similar to FIG. 24 with the end wall of the partition closed.
Figure 26:
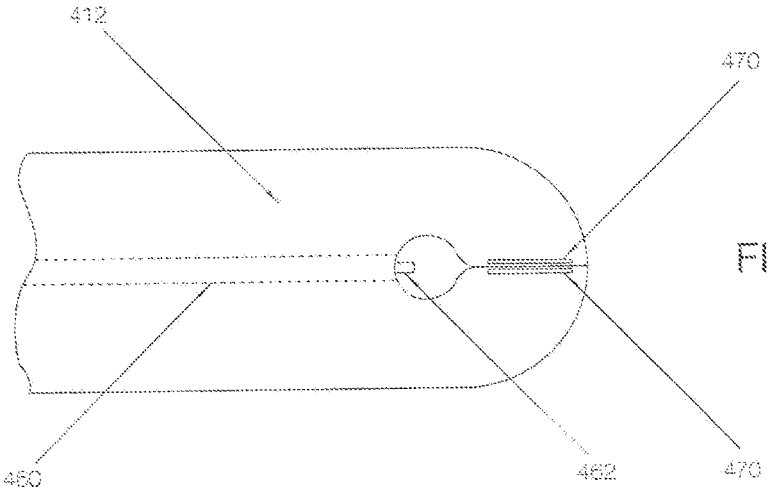
FIG. 26 is a plan view of FIG. 25.
Figure 27:
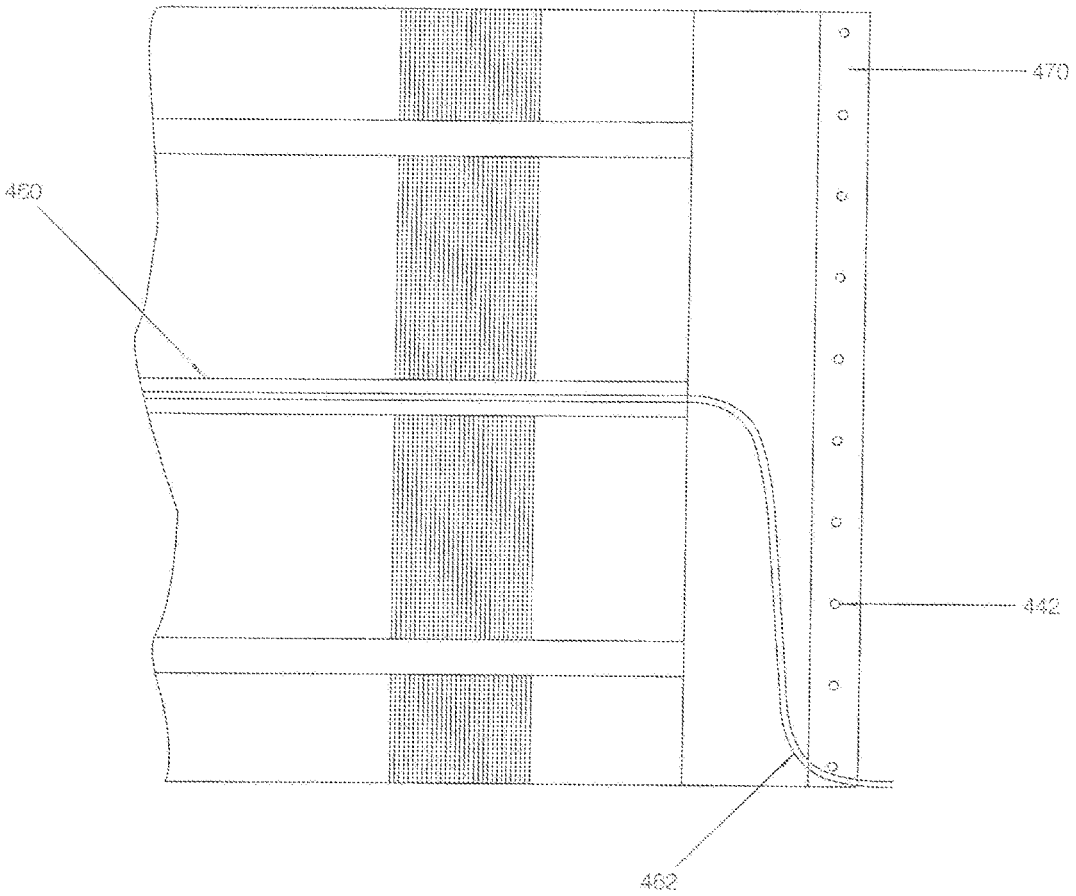
FIG. 27 is a section on the line XXVII-XXVII of FIG. 25.
Figure 28:
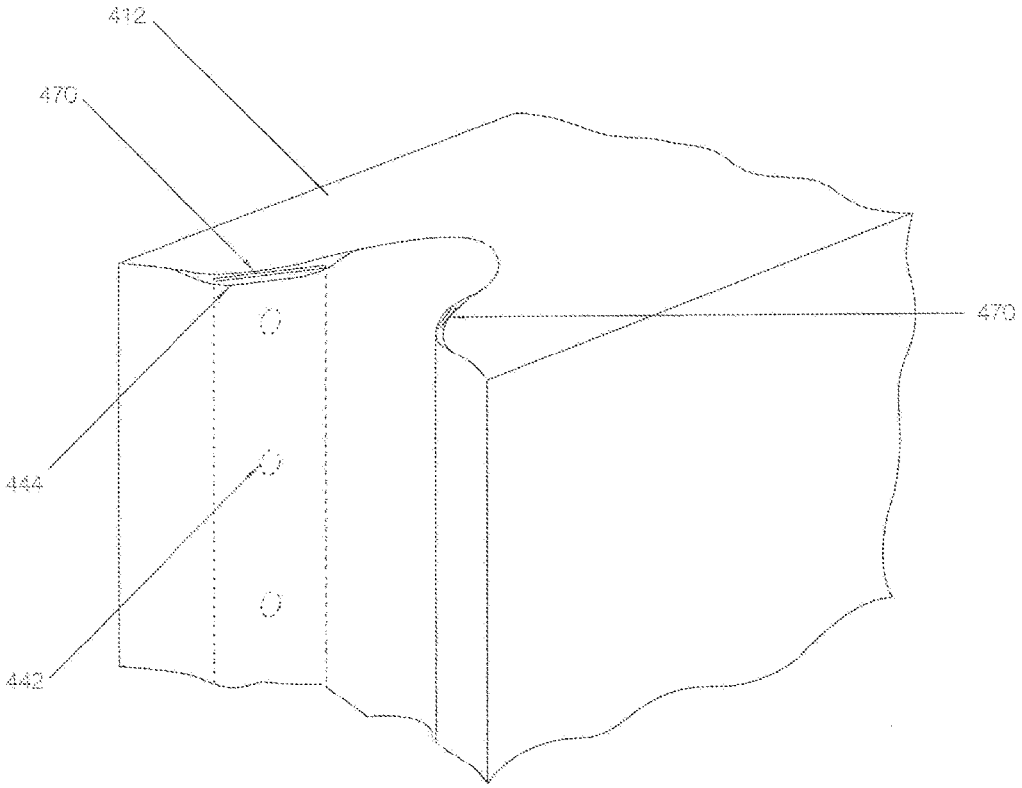
FIG. 28 is an enlarged view showing a portion of the end wall of FIG. 25.

As shown in FIG. 23, the ribbon 462 may also be secured by a bar 466 that passes through the ribbon but inhibits its removal through the passage 462.

As shown in FIGS. 24 through 27, the ribbon 462 may conveniently be concealed by the end panel 414 with the partition installed. The end panel 414 may be folded upon itself, as described above with respect to FIG. 5 to define a hollow vertical cavity in which the ribbon 46 can be concealed.

The end panels 414 and 416 carry magnets 442 in a manner similar to that described with respect to FIG. 10. The magnets 442 are located in recesses formed in plastic strips 470 secured to the end panels 414, 416 and covered by the material 444. The magnets 442 are arranged in uniform spacing down each strip 470 and the polarity of the magnets 442 alternated both vertically along the strip and transversely between the two strips. In this manner, folding of the panels 414, 416 brings magnets of opposite polarity in to contact to secure the end panels in a folded condition. At the same time, the alternating polarity of the magnets 442 along each strip 470 permits successive partitions to be connected end to end even if one is inverted relative to the other as the magnetic connection between adjacent end panels will be obtained, regardless of the orientation of the partitions 410.

In use, the ribbons 462 are inserted into the passages 460 and the ribbons secured by the end fasting in the form of a disc 464 or bar 466. This is most conveniently accomplished with the core 412 in the collapsed condition. As the partition 410 is expanded to the required length, the ribbon 462 slides within the passage way 460 so that the LED ribbon is uniformly distributed along the extended length of the core 412. The end panels 414, 416 are then folded on themselves with the ribbon 46 enclosed within the cavity. The relative sizing between the ribbons and the passage 460 ensures the ribbon can slide easily along the passage as the partition is expanded without binding or tearing the core 412.

When energized, the light from the LED is diffused through the core 412 giving a glowing appearance to the core 412. The intensity of the light may be adjusted by using more than one ribbon in the core 412 or increasing the number of lights for a given length of core. Controls including a dimmer switch may also be used to contain intensity and may incorporate additional features such as motion sensors that allow the LED's to be switched successively as a person walks past the partition. Different coloured ribbons 462 may also be utilized to vary the visual effect.

The construction of the core 412 and the nature of the material making up the core effectively provides a relatively uniform diffusion of the light through the core, giving a soft glowing effect without high intensity point sources. The LED lights are relatively low heat output and so may be safely incorporated within the core 412 without risk of fire.

In order to store the partition 410, the end walls 414, 416 are brought together to collapse the core 412. As the core 412 is collapsed, the ribbon 462 slides out of the passage 460 so as not to hinder the collapse of the core 412. The ribbon 462 may either remain fixed within the passage 460. or, if preferred, may be detached removed from the passage 460 for storage. The placement of the ribbon 462 within the passage 460 allows adjustment of the overall length of the partition 410 with the ribbon 462 conveniently sliding within the passage 460 during extension or collapse of the partition. As such the ribbon 462 does not inhibit the flexibility or placement of the partition in use.

It will be apparent from the various embodiments described above that the provision of the cellular structure to form the core and the releasable fastenings provided at the end panels allow for a variety of configurations to be provided. The provision of the magnets or other fasteners in a pre-defined grid permits different components to be joined to one another to increase a variety of configurations that may be utilized. As indicated above, the dimensions of the core may be adjusted to suit particular requirements, ranging from a single row of voids to provide a thin or narrow partition, to a relatively wide cellular structure with multiple rows of voids to provide seating or table like surfaces.

Although the invention has been described with reference to certain specific embodiments, various modifications thereof will be apparent to those skilled in the art without departing from the spirit and scope of the invention as outlined in the claims appended hereto. The entire disclosures of all references recited above are incorporated herein by reference.

What is claimed is:

1. A flexible article having a core formed from a plurality of laminar panels of a flaccid material that are inter-connected to provide an expandable structure upon movement of the panels away from each other, opposite ends of the core terminating in a pair of end panels whereby the end panels may be moved apart to expand the expandable structure, a passage extending in a direction between the end panels and intersecting the panels, and a light source located within the passage and operable to illuminate the core from the interior thereof.

2. The flexible article of claim 1 further comprising a magnet positioned within each of the end panels.

3. The flexible article of claim 1 wherein each of the end panels is covered by wrapping.

4. The flexible article of claim 1 wherein the panels are a fire-resistant material.

5. The flexible article of claim 1 wherein the light source includes LEDs.

6. The flexible article of claim 5 wherein the LEDs are positioned on a LED ribbon.

7. A flexible article having a core formed from a plurality of laminar panels that are inter-connected to provide an expandable structure upon movement of the panels away from each other, opposite ends of the core terminating in a pair of end panels whereby the end panels may be moved apart to expand the expandable structure, a light source embedded within the core and operable to illuminate the core from the interior thereof, and a magnet is positioned within each of the end panels, wherein the core is expanded when the end panels are in abutment with one another to form a circular configuration of the article with the magnets securing the end panels to one another.

8. The flexible article of claim 7 wherein the light source is within a passage that is defined within the core and that extends between the end panels.

9. The flexible article of claim 7 wherein the light source includes LEDs.

10. The flexible article of claim 9 wherein the LEDs are positioned on a LED ribbon.

11. The flexible article of claim 7 wherein the magnet in each of the end panels is located in a recess formed in a plastic strip.

12. A flexible article having a core formed from a plurality of laminar panels of a flaccid material that are inter-connected to provide an expandable structure upon movement of the panels away from each other, opposite ends of the core terminating in a pair of rigid end panels whereby the panels may be moved apart to expand the expandable structure, a light source located and concealed within the core and operable to illuminate the core from the interior thereof, and a magnet is positioned within each of the rigid end panels.

13. The flexible article of claim 12 wherein each of the end panels are covered by a wrapping.

14. The flexible article of claim 12 wherein the magnet in each of the end panels is located in a recess formed in a plastic strip.

15. The flexible article of claim 12 wherein the light source includes LEDs.

16. The flexible article of claim 12 wherein the LEDs are positioned on a LED ribbon.

17. A lighting apparatus comprising:

a flexible core formed from a plurality of laminar panels of a flaccid material that are inter-connected to provide an expandable structure upon movement of the panels away from each other, opposite ends of the core terminating in a pair of end panels whereby the panels may be moved apart to expand the expandable structure, wherein a magnet is embedded in each of the end panels;

a light source located and concealed within the core and operable to illuminate the core from the interior thereof; and a transformer unit and an electrical power supply that supplies power to the light source.

18. The lighting apparatus of claim 17 wherein the light source includes LEDs.

19. The lighting apparatus of claim 17 wherein the LEDs are positioned on a LED ribbon.

20. The lighting apparatus of claim 17 wherein each of the end panels comprises a plastic strip, and each of the magnets is located in a recess formed in the plastic strip.

* * * * *